US007740052B2

(12) United States Patent
Marti et al.

(10) Patent No.: US 7,740,052 B2
(45) Date of Patent: Jun. 22, 2010

(54) METHOD FOR EXTENDING THE CASTING CYCLE FOR TWO-ROLL STRIP CASTING, AND INSTALLATION FOR CARRYING OUT SAID METHOD

(75) Inventors: Heinrich Marti, Forch (CH); Jacques Barbé, Tarantaise (FR)

(73) Assignees: SMS Siemag Aktiengesellschaft, Düsseldorf (DE); Main Management Inspiration AG, Hergiswil (CH)

( * ) Notice: Subject to any disclaimer, the term of this patent is extended or adjusted under 35 U.S.C. 154(b) by 769 days.

(21) Appl. No.: 10/567,932

(22) PCT Filed: Aug. 13, 2004

(86) PCT No.: PCT/EP2004/009129

§ 371 (c)(1),
(2), (4) Date: Dec. 8, 2006

(87) PCT Pub. No.: WO2005/018843

PCT Pub. Date: Mar. 3, 2005

(65) Prior Publication Data

US 2007/0187065 A1 Aug. 16, 2007

(30) Foreign Application Priority Data

Aug. 13, 2003 (CH) ..... 1398/03

(51) Int. Cl.
*B22D 11/06* (2006.01)
*B22D 11/12* (2006.01)

(52) U.S. Cl. ..... 164/480; 164/448

(58) Field of Classification Search ..... 164/442, 164/448, 483, 480
See application file for complete search history.

(56) References Cited

U.S. PATENT DOCUMENTS 4,362,206 A * 12/1982 Cordella et al. ..... 164/448
4,411,053 A * 10/1983 Scheurecker ..... 29/267

FOREIGN PATENT DOCUMENTS

DE 101 63 373 2/2003
DE 101 63 373 C1 * 2/2003
EP 0 707 908 4/1996

* cited by examiner

*Primary Examiner*—Kevin P Kerns
(74) *Attorney, Agent, or Firm*—Friedrich Kueffner

(57) ABSTRACT

A method for extending the casting cycle for the two-roll strip casting of a steel strip, with inline rolling thereof, the steel strip being rolled in at least two successive rolling units of a rolling mill having replaceable working rolls. The casting process is carried out independently from the roll replacement by replacing the working rolls of one rolling unit during the casting, below or above the steel strip. An installation for carrying out the method includes a lifting devices for lifting the working rolls off the steel strip so as not to damage the strip during the replacement of the rolls.

13 Claims, 3 Drawing Sheets

METHOD FOR EXTENDING THE CASTING CYCLE FOR TWO-ROLL STRIP CASTING, AND INSTALLATION FOR CARRYING OUT SAID METHOD

BACKROUND OF THE INVENTION

The invention concerns a method for extending the casting cycle in two-roll strip casting with in-line rolling of steel strip, which is rolled in at least one and preferably two successive rolling units of a rolling mill with changeable work rolls. The invention also concerns an installation for carrying out this method.

As is well known, rolling mill work rolls are subject to wear during operation. Therefore, it is necessary during the rolling operation to regularly change especially the work rolls of the rolling units in the final strip thickness range to prevent wear marks on the final strip from resulting in defects and to prevent the production of a poor strip surface.

In the conventional hot-rolling operation, the work rolls of the last rolling units are changed approximately every three hours of operation. The roll change is carried out in a discontinuous operation, i.e., between the rolling operations.

In the new type of two-roll strip casting with in-line rolling, the rolling temperature is about 1,000-1,200° C., i.e., as high as in conventional hot-rolling practice. However, the strip speed is only 0.5-2.0 m/s, i.e., much lower than in conventional hot-rolling practice, in which rolling is carried out at rolling speeds of about 20 m/s. In this regard, casting cycles of 10 hours or more are strived for in the casting process.

SUMMARY OF THE INVENTION

The objective of the invention is to extend the casting cycle in two-roll strip casting of steel strip with in-line rolling of the steel strip.

In accordance with the invention, this objective is achieved by changing the work rolls of one of the rolling units in the rolling mill above and below the steel strip during casting. In this way, it is possible to continue the casting operation indefinitely, independently of the rolling operation, because the casting cycle is not limited by the limited life of the roll surface of the rolling mill work rolls.

The invention also provides that during the roll change a greater strip thickness is produced with the work rolls of the other rolling unit that is in use than before the roll change, namely, according to the reduction rate of this unit.

In accordance with the invention, it is alternatively provided that during the roll change the same strip thickness is temporarily produced without transition with the work rolls of the rolling unit that is in use as before the roll change, in which case these work rolls take on the total reduction rate of both rolling units. The strip thickness that is being run thus remains unchanged during the roll-changing operation.

To avoid deviations of the strip thickness during the transition phase, the invention provides that the given strip thickness that is being run is controlled for the time being with the work rolls of the rolling unit that is still in use, before the work rolls that are to be changed are released.

To support the work of the rolling unit that is still in use, the invention provides that, during the roll change, the casting process parameters that critically affect the casting thickness are varied, such as casting rate and/or bath level and/or heat dissipation and/or temperature of the liquid steel supply. This makes it possible to vary the casting thickness during the roll change according to the requirements of the rolling unit that is still in use.

The invention also concerns an installation for carrying out the method of the invention, whose rolling units are provided with work rolls that can be changed above and below the steel strip. In accordance with the invention, to avoid damage to the steel strip during the roll change, the upper work rolls are provided with lifting devices, by means of which the upper work rolls can be lifted from the steel strip.

For this purpose, the invention provides that the work rolls can be lifted by the lifting devices and that the rolling mill is provided with lifting rolls for the steel strip before and after the work rolls. It is advantageous for the lifting rolls to be mounted on the free ends of pivoted levers.

Coordinated lifting of the work rolls and the steel strip produces a gap between the steel strip and the work rolls, and this gap ensures contact-free passage of the steel strip between the work rolls that are to be changed.

In this connection, it is advantageous in accordance with a simple mode of operation, if the upper work roll can be lifted together with its associated backup roll.

To facilitate or speed up the roll-changing operation, the invention provides that the work rolls can be supported on guides that can move with them and/or that can be swung in and out.

If the wear of the work rolls to be changed is variable, then it is advantageous if the work rolls can be individually changed. Otherwise, however, it is advantageous to change both work rolls simultaneously in pairs. In this case, the invention provides that the work rolls to be changed are provided with a common extraction device.

The invention is explained in greater detail below with reference to the specific embodiment illustrated in the drawings.

DETAILED DESCRIPTION OF THE INVENTION

Figure 1:
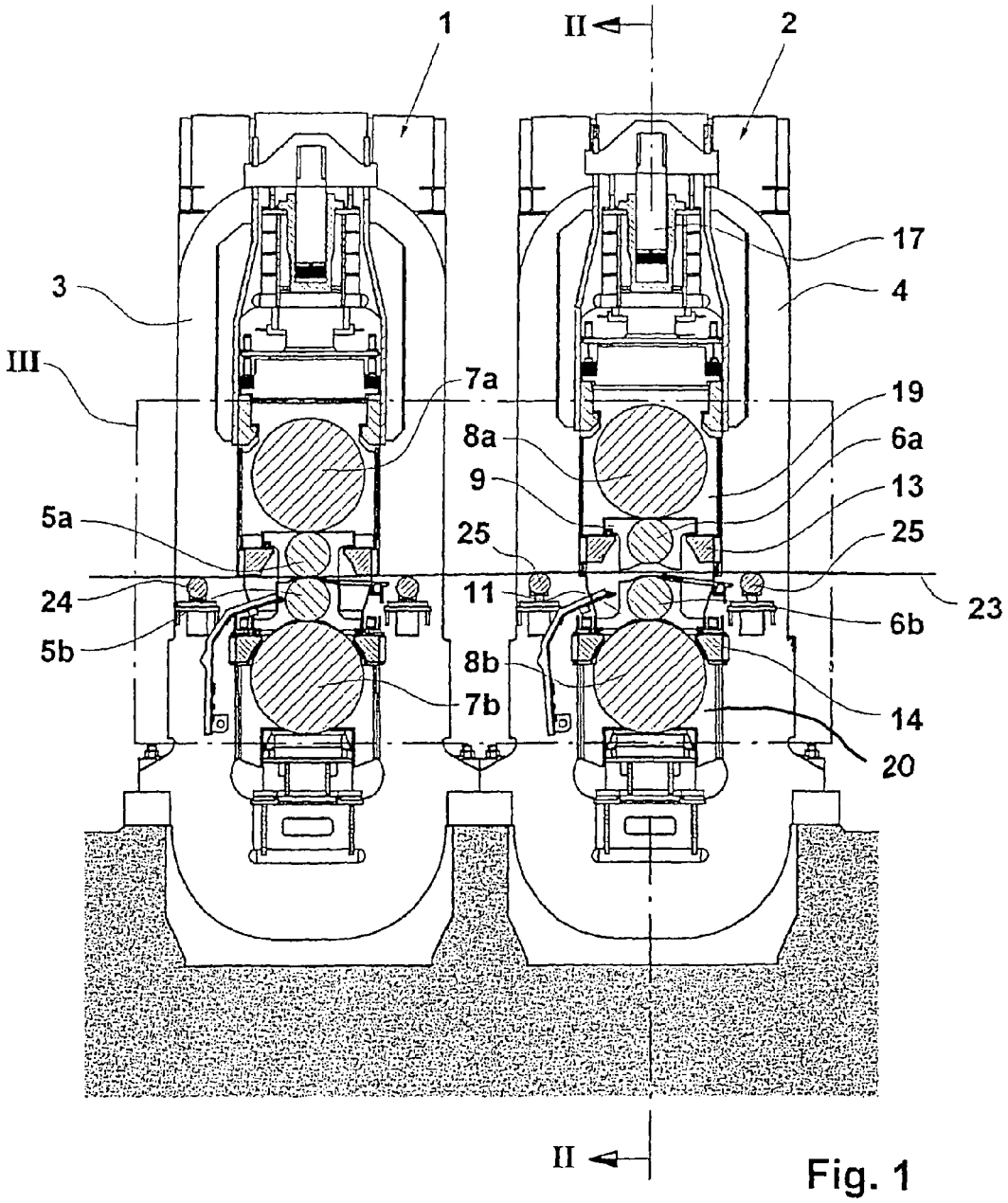
FIG. 1 shows a side view of the in-line rolling mill of a two-roll casting installation.
Figure 2:
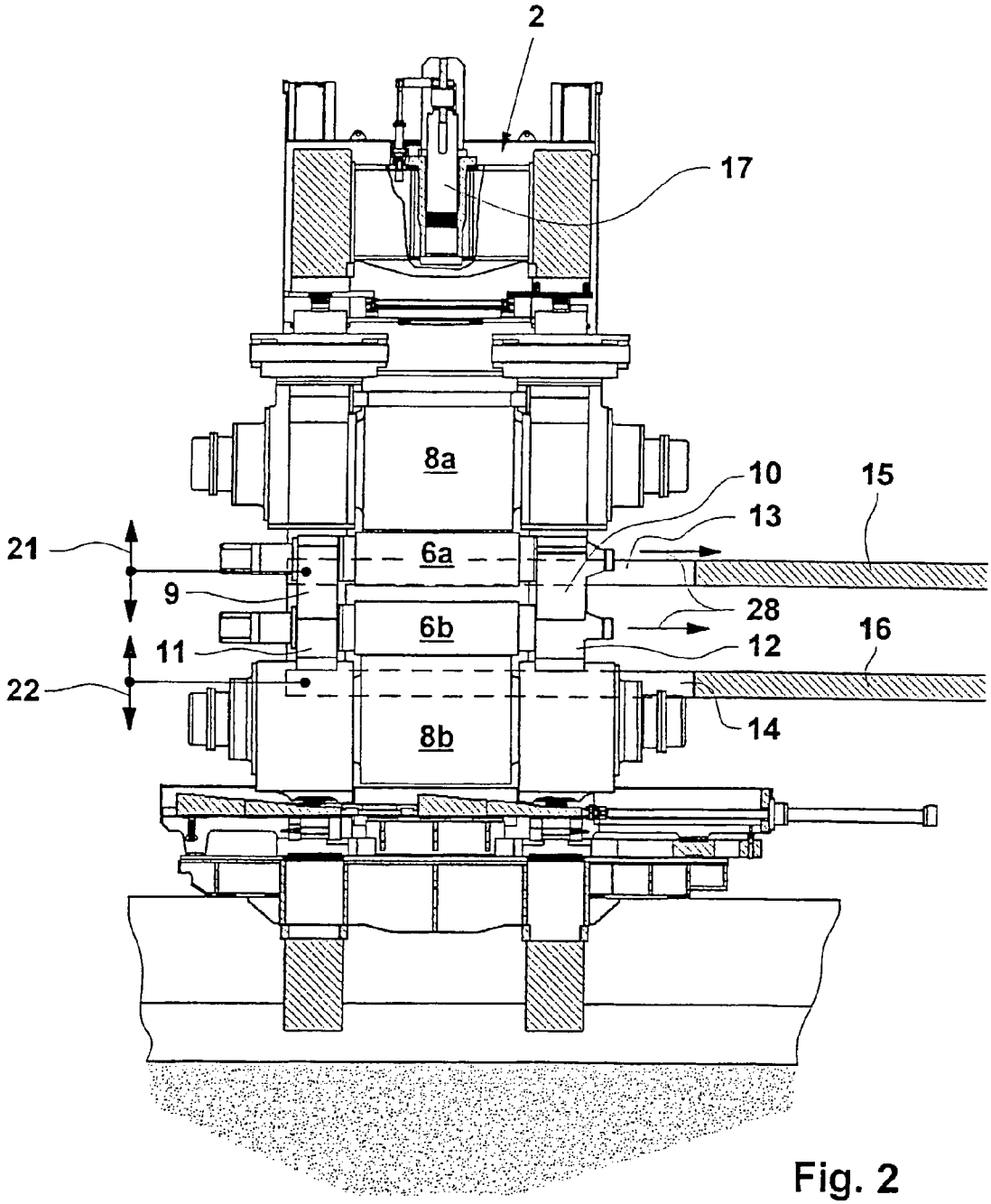
FIG. 2 shows the rolling mill of FIG. 1 in a section along line II-II in FIG. 1.

The rolling mill illustrated in FIGS. 1 and 2 consists of two successive rolling units 1 and 2, each of which is equipped with a stand 3 and 4, respectively, and a pair of rolling mill work rolls 5*a*, 5*b* and 6*a*, 6*b*, respectively, with backup rolls 7*a*, 7*b* and 8*a*, 8*b*, respectively. The two rolling units have identical designs in all respects. Therefore, for the sake of simplicity, only rolling unit 2 will be described in detail.

The work rolls 6*a*, 6*b* of this unit are supported on bearing boxes 9, 10 and 11, 12, respectively, which are supported on guide supports 13 and 14, respectively. Additional guides 15, 16 are mounted as a continuation of these supports for holding the work rolls 6*a* and 6*b* during the roll change.

The guide supports 13, 14 and thus the work rolls 6*a* and 6*b*, respectively, that are supported on them can be lifted by hydraulic lifting devices 17, which act on support housings 19 and 20, respectively, of the guide supports 13, 14 along with the work rolls 6*a* and 6*b*, respectively. Their lifting direction is indicated in FIG. 2 by reference numbers 21, 22.

Figure 3:
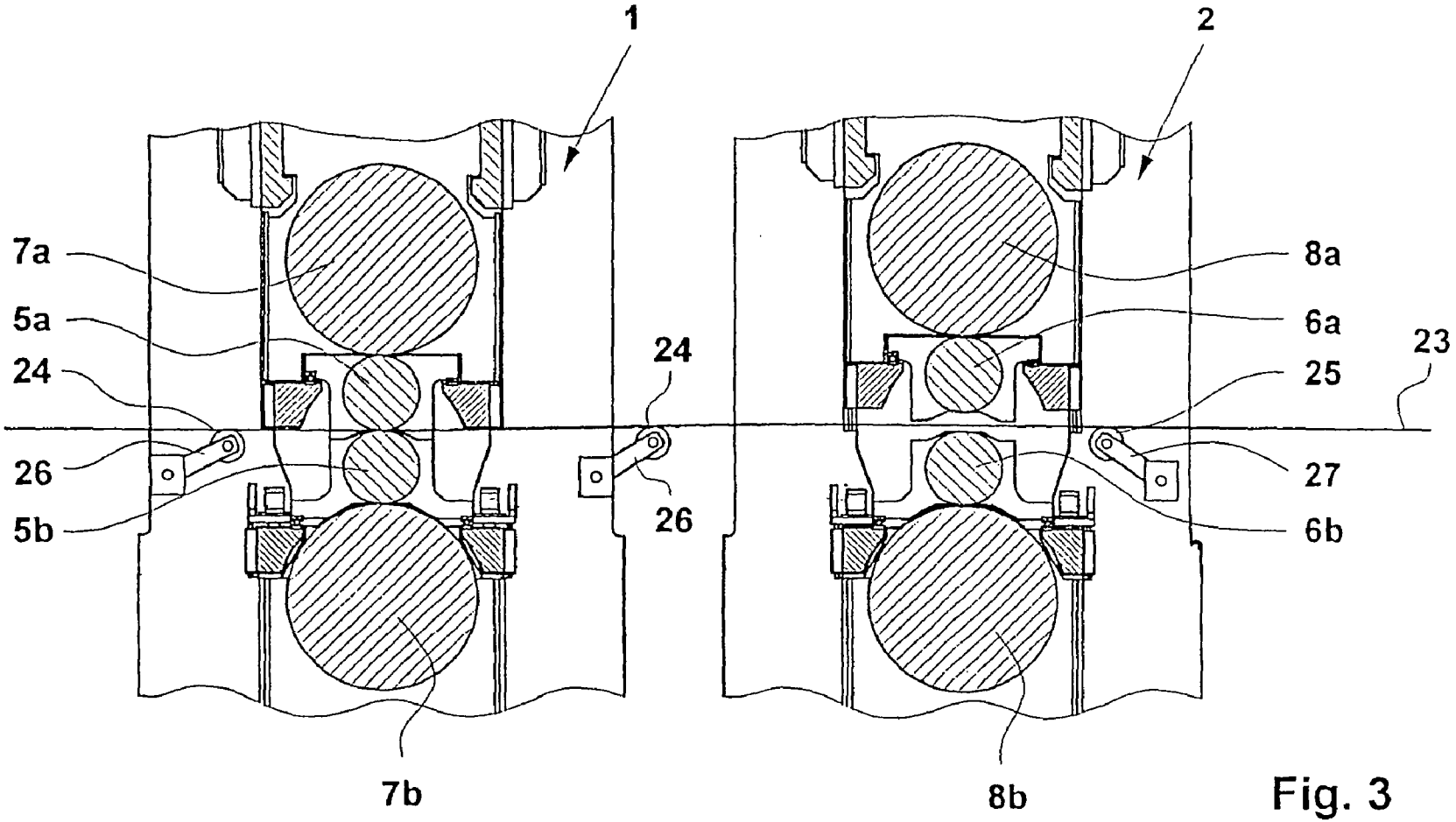
FIG. 3 shows the schematic detail section III from FIG. 1 with a design variant of the lifting rolls for the steel strip.

The steel strip 23, which is produced in the two-roll casting installation (not shown), passes through the rolling units 1 and 2 supported on lifting rolls 24, 25, which can be hydraulically lifted and are positioned before and after the work rolls 5*a*, 5*b* and 6*a*, 6*b*, respectively, of the rolling units 1 and 2. In the variant illustrated in FIG. 3, the lifting rolls 24, 25 are mounted on the free ends of pivoted levers 26 and 27, respectively.

An extraction device (not shown) for joint extraction of the work rolls 6*a*, 6*b* from the area of the rolling line is assigned to the work rolls. The direction of extraction of the work rolls is indicated in FIG. 2 by reference number 28.

To change the work rolls 6*a* and 6*b* of rolling unit 2, the given strip thickness that is being run is first controlled with the work rolls 5*a*, 5*b* of rolling unit 1, namely, before the pair of work rolls 6*a*, 6*b* to be changed is released. This mode of operation ensures that the same strip thickness continues to be temporarily produced without transition with rolling unit 1 as has been previously produced with the two rolling units 1 and 2 together, in which case rolling unit 1 then takes on the total reduction rate of the two rolling units.

The guide supports 13 and 14 together with the work rolls 6*a*, 6*b* are then lifted by the lifting devices 17. At the same time, the steel strip 23 is also lifted by the lifting rolls 24, 25.

In this regard, the lift distance of the work rolls and of the steel strip is adjusted in such a way that, after the work rolls have been lifted above and below the steel strip, a gap is formed between the steel strip and the work rolls. This ensures that during the work roll change, the work rolls do not cause any damage to the surfaces of the strip.

In accordance with the invention, it is also immediately possible to design the lifting devices 17 in such a way that they act directly on the guide supports 13, 14 of the work rolls 6*a*, 6*b*. In this case, the upper work roll 6*a* is lifted together with its backup roll 8*a*, while the lower work roll 6*b* is lifted by itself without its backup roll.

After the work rolls 6*a* and 6*b* have been lifted, they are extracted together from the area of the rolling line in the direction of arrow 28 on the guide supports 13, 14 and on the guides 15, 16 that constitute continuations of the guide supports, and they are then removed to the repair shop. To facilitate this operation, the guides 15, 16 can be moved together with the work rolls. According to requirements, they can also be swung in and out.

The mounting of the new work rolls is carried out in similar fashion but in the opposite order.

Naturally, it is also possible, in accordance with the invention, to change the work rolls individually, and in this case, each work roll can have its own extraction device.

It is also possible to work in such a way during the changing of the work rolls that a greater strip thickness is produced with the work rolls of the rolling unit that is still in use during the roll change, specifically, by using the reduction rate of this unit. This simplifies the control of the rolling mill during the roll-change operation.

Naturally, the method that has been described can also be used to change the work rolls 5*a*, 5*b* of rolling unit 1. In addition, it can be used in rolling mills with more than two successive rolling units.

The invention claimed is:

1. Method for extending a casting cycle in two-roll strip casting with in-line rolling of steel strip, which is rolled in two successive rolling units (1, 2) of a rolling mill with changeable work rolls (5*a*, 5*b*, 6*a*, 6*b*), wherein the work rolls (5*a*, 5*b*; 6*a*, 6*b*) that are to be changed are changed above and below the steel strip (23) by separating the work rolls to form a gap between the work rolls and the steel strip and laterally extracting the work rolls from the rolling unit (1, 2) during casting.

2. Method in accordance with claim 1, wherein, in the case of two successive rolling units (1, 2), during a roll change of rolling unit (2), a greater strip thickness is produced with the work rolls (5*a*, 5*b*) of the other rolling unit (1) that is still in use than was produced before the roll change.

3. Method in accordance with claim 1, wherein, in the case of two successive rolling units (1, 2) during a roll change of rolling unit (2), the same strip thickness is temporarily produced without transition with the work rolls (5*a*, 5*b*) of the rolling unit (1) that is still in use as before the roll change, in which case the work rolls (5*a*, 5*b*) then take on the total reduction rate of the two rolling units (1, 2).

4. Method in accordance with claim 3, wherein a given strip thickness that is being run is controlled for the time being with the work rolls (5*a*, 5*b*) of the rolling unit (1) that is still in use, before the work rolls (6*a*, 6*b*) that are to be changed are released.

5. Method in accordance with claim 3, wherein during the roll change, casting process parameters that critically affect the casting thickness, such as casting rate and/or bath level and/or heat dissipation and/or temperature of a liquid steel supply, are varied in order to support the rolling unit (1) that is still in use.

6. Installation for carrying out the method in accordance with claim 1, whose two successive rolling units (1, 2) are provided with work rolls (5*a*, 5*b*, 6*a*, 6*b*) that are changed above and below the steel strip (23), wherein the work rolls (5*a*, 5*b*; 6*a*, 6*b*) are lifted from the steel strip (23) by lifting devices (17) and are laterally extracted.

7. Installation in accordance with claim 6, wherein the work rolls (5*a*, 5*b*; 6*a*, 6*b*) are lifted by the lifting devices (17) and the rolling mill is provided with lifting rolls (24, 25) for the steel strip (23) before and after the work rolls.

8. Installation in accordance with claim 7, wherein the lifting rolls (24, 25) are mounted on free ends of pivoted levers (26, 27).

9. Installation in accordance with claim 7, wherein the upper work roll (5*a*, 6*a*) are lifted together with its backup roll (7*a*, 8*a*).

10. Installation in accordance with claim 6, wherein the work rolls (5*a*, 5*b*; 6*a*, 6*b*) are supported on guides (13, 14, 15, 16) that move with them and/or that are swung in and out.

11. Installation in accordance with claim 6, wherein the work rolls (5*a*, 5*b*; 6*a*, 6*b*) are changed separately or in pairs.

12. Installation in accordance with claim 11, wherein the work rolls (5*a*, 5*b*; 6*a*, 6*b*), which are changed in pairs, are provided with a common extraction device.

13. Installation in accordance with claim 6, wherein the upper work roll (5*a*, 6*a*) is lifted together with the upper backup roll (7*a*, 8*a*) and/or the lower work roll (5*b*, 6*b*) is lowered together with the lower backup roll (7*b*, 8*b*).

* * * * *